US009296510B2

(12) United States Patent
Marshall et al.

(10) Patent No.: US 9,296,510 B2
(45) Date of Patent: Mar. 29, 2016

(54) TEAR TAB CLOSURE STRIP

(71) Applicant: Boston Scientific Scimed, Inc., Maple Grove, MN (US)

(72) Inventors: Amie Marshall, Maple Grove, MN (US); Ross Christianson, Dassel, MN (US); Alyssa Downing, Minneapolis, MN (US); Patrick R. Moran, Maple Grove, MN (US); Tom Stoddart, Hopkins, MN (US); Phillip Lozanoski, Eden Prairie, MN (US); Richard A. Tuma, Minneapolis, MN (US); James M. Peck, Maple Grove, MN (US); Duane J. Huberty, Oakdale, MN (US); David Olson, St. Anthony, MN (US)

(73) Assignee: BOSTON SCIENTIFIC SCIMED, INC., Mapple Grove, MN (US)

( * ) Notice: Subject to any disclaimer, the term of this patent is extended or adjusted under 35 U.S.C. 154(b) by 0 days.

(21) Appl. No.: 14/170,192

(22) Filed: Jan. 31, 2014

(65) Prior Publication Data

US 2014/0217163 A1 Aug. 7, 2014

Related U.S. Application Data

(60) Provisional application No. 61/759,953, filed on Feb. 1, 2013.

(51) Int. Cl.
*B65D 5/54* (2006.01)
*B65D 5/02* (2006.01)

(52) U.S. Cl.
CPC ..... *B65D 5/54* (2013.01); *B65D 5/0236* (2013.01); *B65D 2101/00* (2013.01); *B65D 2255/06* (2013.01)

(58) Field of Classification Search
USPC ..... 229/200, 208, 125.14, 80.5; 222/541; 383/62
See application file for complete search history.

(56) References Cited

U.S. PATENT DOCUMENTS

| | | | | |
|---|---|---|---|---|
| 2,013,299 | A | | 1/1935 | Byrne |
| 4,192,420 | A | | 3/1980 | Worrell, Sr. et al. |
| 4,258,876 | A | * | 3/1981 | Ljungcrantz ..... 229/125.14 |
| 4,309,468 | A | | 1/1982 | St. Aubin |
| 4,386,705 | A | | 6/1983 | Meuller |
| 4,386,925 | A | | 6/1983 | Focke |

(Continued)

FOREIGN PATENT DOCUMENTS

| | | | |
|---|---|---|---|
| EP | 0669204 | A1 | 8/1995 |
| JP | 2001072045 | A | 3/2001 |

(Continued)

*Primary Examiner* — Christopher Demeree
(74) *Attorney, Agent, or Firm* — Seager, Tufte & Wickhem, LLP

(57) ABSTRACT

A closure device may include a backing and a closure strip removably provided on the backing, wherein the closure strip includes a permanent adhesive on a back face thereof adapted to affix the closure strip to a package, wherein a breakout portion of the backing is configured to separate from the backing and remain adhered to the closure strip when the closure strip is removed therefrom. A product package may include a carton having a flap movable between an open position and a closed position, and a closure device affixed to a portion of the flap and a separate portion of the carton when the flap is in the closed position, wherein a first portion of the closure device is removable from the separate portion of the carton while the first portion remains attached to the portion of the flap.

17 Claims, 14 Drawing Sheets

(56) References Cited

U.S. PATENT DOCUMENTS

| | | | | |
|---|---|---|---|---|
| 4,514,248 | A | 4/1985 | Cummings | |
| 4,679,693 | A * | 7/1987 | Forman | 383/203 |
| 4,837,061 | A | 6/1989 | Smits et al. | |
| 5,082,702 | A | 1/1992 | Alband | |
| 5,727,819 | A | 3/1998 | Grosskopf et al. | |
| 5,893,587 | A | 4/1999 | Wong | |
| 5,908,246 | A | 6/1999 | Arimura et al. | |
| 5,944,355 | A | 8/1999 | Rich et al. | |
| 6,149,203 | A | 11/2000 | Hanlon | |
| 6,303,202 | B1 | 10/2001 | Washburn et al. | |
| 6,343,695 | B1 | 2/2002 | Petrick et al. | |
| 6,398,028 | B1 | 6/2002 | Stovall | |
| 6,413,605 | B1 | 7/2002 | Hoffer | |
| 6,499,241 | B1 | 12/2002 | Vila-Martinez | |
| 6,508,904 | B1 | 1/2003 | Charley | |
| 6,589,622 | B1 | 7/2003 | Scott | |
| 6,767,604 | B2 | 7/2004 | Muir, Jr. et al. | |
| 7,934,616 | B2 * | 5/2011 | Felber | 220/259.2 |
| 8,187,688 | B2 | 5/2012 | MacWilliams | |
| 8,273,433 | B2 | 9/2012 | Flynn | |
| 8,308,363 | B2 * | 11/2012 | Vogt et al. | 383/5 |
| 2002/0023924 | A1 | 2/2002 | Wisniewski et al. | |
| 2004/0060892 | A1 | 4/2004 | Heston et al. | |
| 2004/0112010 | A1 | 6/2004 | Richards et al. | |
| 2005/0167026 | A1 | 8/2005 | Dronzek et al. | |
| 2005/0230958 | A1 | 10/2005 | Payne et al. | |
| 2005/0230961 | A1 | 10/2005 | Walley | |
| 2007/0024050 | A1 | 2/2007 | White et al. | |
| 2007/0104915 | A1 | 5/2007 | Blancato et al. | |
| 2008/0257673 | A1 | 10/2008 | Mrocki et al. | |
| 2009/0091121 | A1 | 4/2009 | Urbanek | |
| 2010/0154264 | A1 | 6/2010 | Scott et al. | |
| 2011/0171411 | A1 | 7/2011 | Jordan | |
| 2012/0021188 | A1 | 1/2012 | White et al. | |

FOREIGN PATENT DOCUMENTS

| | | | |
|---|---|---|---|
| JP | 2009086043 | A | 4/2009 |
| JP | 2011170222 | A | 9/2011 |

* cited by examiner

TEAR TAB CLOSURE STRIP

CROSS-REFERENCE TO RELATED APPLICATIONS

This application claims priority under 35 U.S.C. §119(e) to U.S. Provisional Application No. 61/759,953, filed Feb. 1, 2013, the entire disclosure of which is herein incorporated by reference.

TECHNICAL FIELD

The disclosure relates generally to product packaging and in particular to a closure apparatus for product packaging.

BACKGROUND

Product packaging may frequently include a three-dimensional box or carton having a flap on one end or two opposing ends. In some cases, the carton may include a locking tab that is inserted through a slit or notch in a tuck flap to secure the tuck flap in place. Some product packaging may also include a closure strip or other apparatus for securing the flap. A continuing need exists for improved closure strips that improve manufacturing and packaging efficiency, reduce cost, and provide other benefits.

SUMMARY

A closure device for product packaging may include a polymeric backing, and a closure strip removably disposed on the backing, wherein the closure strip includes a first end, a second end opposite the first end, a first portion adjacent the first end, a second portion opposite the first portion and adjacent the second end, and a central portion disposed between the first portion and the second portion, wherein the closure strip includes a permanent adhesive on a back face thereof adapted to affix the closure strip to a package, wherein a breakout portion of the backing is configured to separate from a remaining portion of the backing and remain adhered to the closure strip when the closure strip is removed from the backing.

A product package may include a three-dimensional carton having a flap at an end thereof, the flap being movable between an open position and a closed position, and a closure device affixed to a portion of the flap and a separate portion of the carton when the flap is in the closed position, wherein a first portion of the closure device is removable from the separate portion of the carton while the first portion remains attached to the portion of the flap.

A method of packaging a product may include obtaining a package including a flap, inserting the product into the package, closing the package by inserting the flap into an interior of the package, and affixing a closure strip over a portion of the flap and a separate portion of the package, wherein the closure strip includes a tear tab configured to be removable from the separate portion of the package while the tear tab remains attached to the portion of the flap.

Figure 1:
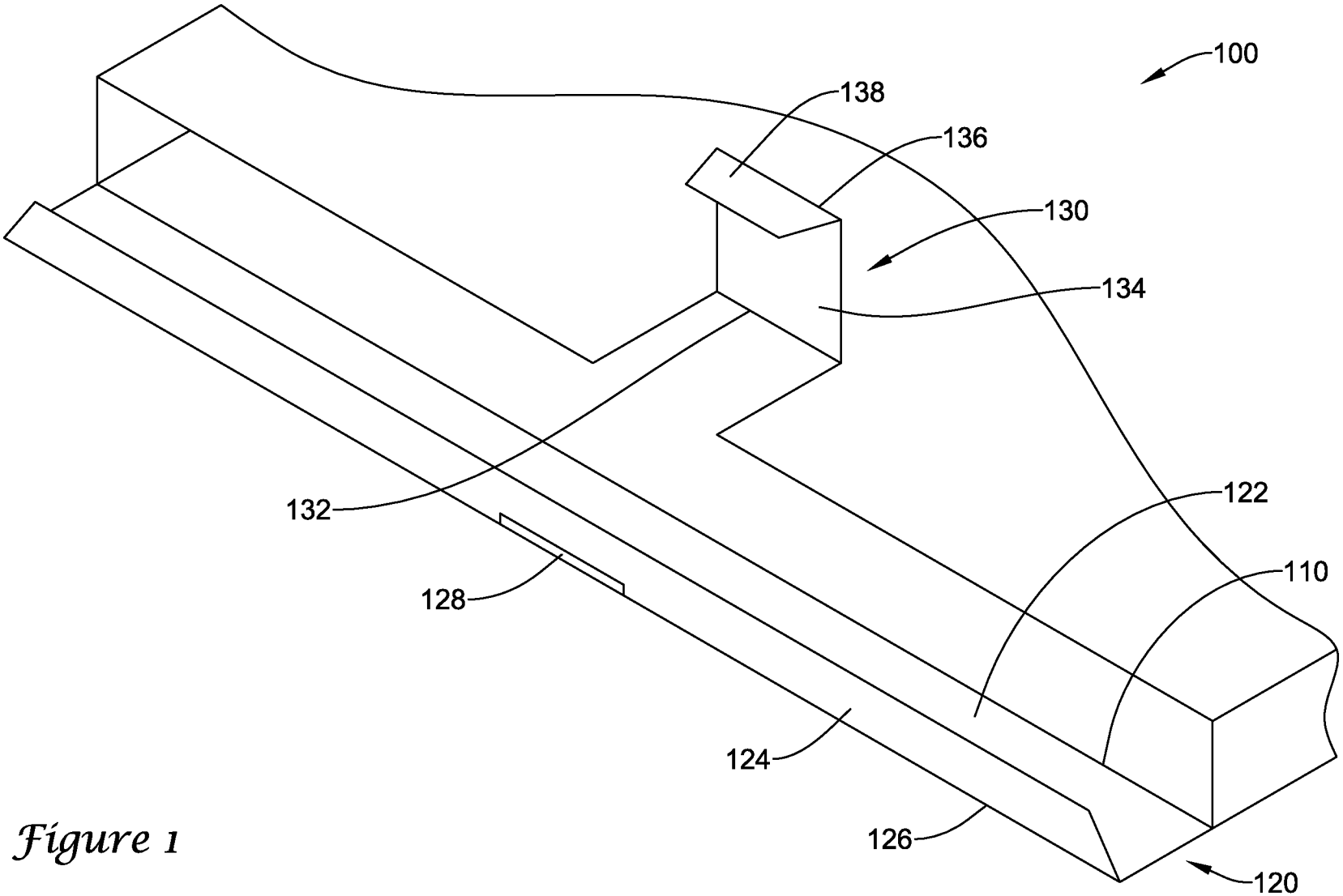
FIG. 1 is a partial perspective view of an example package.

While the invention is amenable to various modifications and alternative forms, specifics thereof have been shown by way of example in the drawings and will be described in greater detail below. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The following description should be read with reference to the drawings, which are not necessarily to scale, wherein like reference numerals indicate like elements throughout the several views. The detailed description and drawings are intended to illustrate but not limit the claimed invention. Those skilled in the art will recognize that the various elements described and/or shown may be arranged in various combinations and configurations without departing from the scope of the disclosure. The detailed description and drawings illustrate example embodiments of the claimed invention.

For the following defined terms, these definitions shall be applied, unless a different definition is given in the claims or elsewhere in this specification.

All numeric values are herein assumed to be modified by the term "about," whether or not explicitly indicated. The term "about", in the context of numeric values, generally refers to a range of numbers that one of skill in the art would consider equivalent to the recited value (i.e., having the same function or result). In many instances, the term "about" may include numbers that are rounded to the nearest significant figure. Other uses of the term "about" (i.e., in a context other than numeric values) may be assumed to have their ordinary and customary definition(s), as understood from and consistent with the context of the specification, unless otherwise specified.

Weight percent, percent by weight, wt %, wt-%, % by weight, and the like are synonyms that refer to the concentration of a substance as the weight of that substance divided by the weight of the composition and multiplied by 100.

The recitation of numerical ranges by endpoints includes all numbers within that range, including the endpoints (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of one skilled in the art to effect such feature, structure, or characteristic in connection with other embodiments, whether or not explicitly described, unless clearly stated to the contrary. That is, the various individual elements described below, even if not explicitly shown in a particular combination, are nevertheless contemplated as being combinable or arrangeable with each other to form other additional embodiments or to complement and/or enrich the described embodiment(s), as would be understood by one of ordinary skill in the art.

FIG. 1 schematically illustrates an example package 100 such as a carton or box, as may be used to hold or retain a medical device during shipment and storage. In some embodiments, the package 100 may include a movable and/or actuatable partition or flap 120, for example, a tuck flap. In some embodiments, the package 100 may include at least one flap 120. In some embodiments, the package 100 may include two or more flaps 120. In some of those embodiments, the two or more flaps 120 may be disposed on opposing ends of the package 100, or the two or more flaps 120 may be disposed in other arrangements known in the packaging art. The at least one flap 120 may be pivotably attached to the package 100 at a first flap bend 110 formed at one end of the package 100. In some embodiments, the at least one flap 120 may be integrally or unitarily formed with the package 100. In some embodiments, the at least one flap 120 may be formed as a separate element and later joined to the package 100, using adhesive(s), mechanical fastening means, or other attachment means known to the skilled artisan.

In some embodiments, such as illustrated in FIG. 1, the at least one flap 120 may form a tuck flap including a first panel 122 adjacent to the first flap bend 110, a second panel 124, and a second flap bend 126 pivotably joining the first panel 122 to the second panel 124. The second flap bend 126 may be oriented substantially parallel to the first flap bend 110. In some embodiments, the second panel 124 may be configured to be inserted into an interior of the package 100 along and/or flush against an inside surface thereof. However, it will be appreciated by the skilled artisan that the flap 120 need not necessarily be formed as a tuck flap, and may be formed without the second flap bend 126 and/or the second panel 124.

In some embodiments where the at least one flap 120 is formed as a tuck flap, the at least one flap 120 may include a slot or notch 128 adjacent to the second flap bend 126. In some embodiments, the slot or notch 128 may be substantially parallel to the second flap bend 126. In some embodiments having a slot or notch 128, the package 100 may include a locking tab 130. The locking tab 130 may be pivotably attached to the package 100 at a first locking tab bend 132, located generally opposite the first flap bend 110 about the interior of the package 100. The first locking tab bend 132 may be disposed a first distance from the one end of the package 100 having the first flap bend 110. The first distance may generally be equal to a length of a first locking tab panel 134 extending from the first locking tab bend 132 to a second locking tab bend 136. A second locking tab panel 138 may be pivotably attached to the first locking tab panel 134 at the second locking tab bend 136. The second locking tab bend 136 may be oriented substantially parallel to the first locking tab bend 132. In some embodiments, the second locking tab panel 138 may be configured to be inserted through the slot or notch 128 and into an interior of the package 100 along and/or flush against an inside surface thereof. Inserting the second locking tab panel 138 through the slot or notch 128 may effectively "lock" the at least one flap 120 in a closed position wherein the interior of the package 100 is not accessible from outside of the package 100. Withdrawing or removing the second locking tab panel 138 from the slot or notch 128 may permit the second panel 124 of the at least one flap 120 to be withdrawn from the interior of the package 100 to assume an open position wherein the interior of the package 100 is accessible from outside of the package 100.

In some embodiments, an example package 100 may be formed from or otherwise include paper, paperboard, fiberboard, cardboard (including corrugated cardboard), polymer or plastic such as high-density polyethylene (HDPE), Mylar®, Tyvek®, polyester, etc., composites, and/or combinations thereof, as well as other suitable packaging materials known in the art. In some embodiments, the example package 100 may include a plurality of layers, including layers of differing materials. Overall length, width, and/or depth of the example package 100 may be varied and/or adjusted as necessary to accommodate various products which may be contained therein.

Figure 2A:
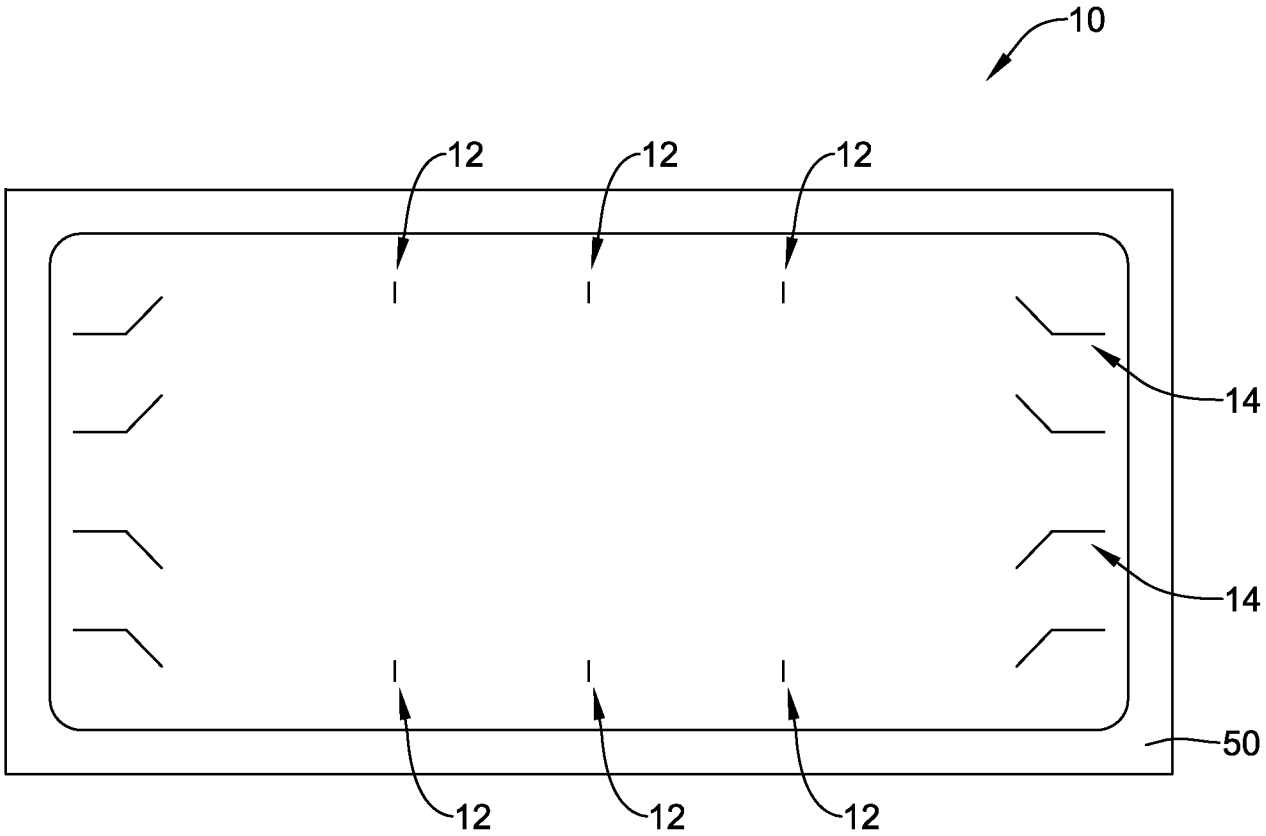
Figure 2A Prior Art
FIGS. 2A-2E illustrate an example prior art closure strip.

FIG. 2A illustrates an example prior art closure strip 10. The closure strip 10 includes three perforations 12 on each side of the closure strip 10, and a set of "tree tears" 14 on each end of the closure strip 10. The closure strip 10 may have an ornamental front face (i.e., company name or slogan, product labeling or information, etc.) and a back face covered with adhesive. The closure strip 10 may be removably provided on a backing 50, wherein the adhesive on the back face is configured to peel off the backing 50 when manipulated by a user such that the closure strip 10 peels off whole for application to a package, such as package 100. The entire back face may be covered or coated with adhesive.

Figure 2B:
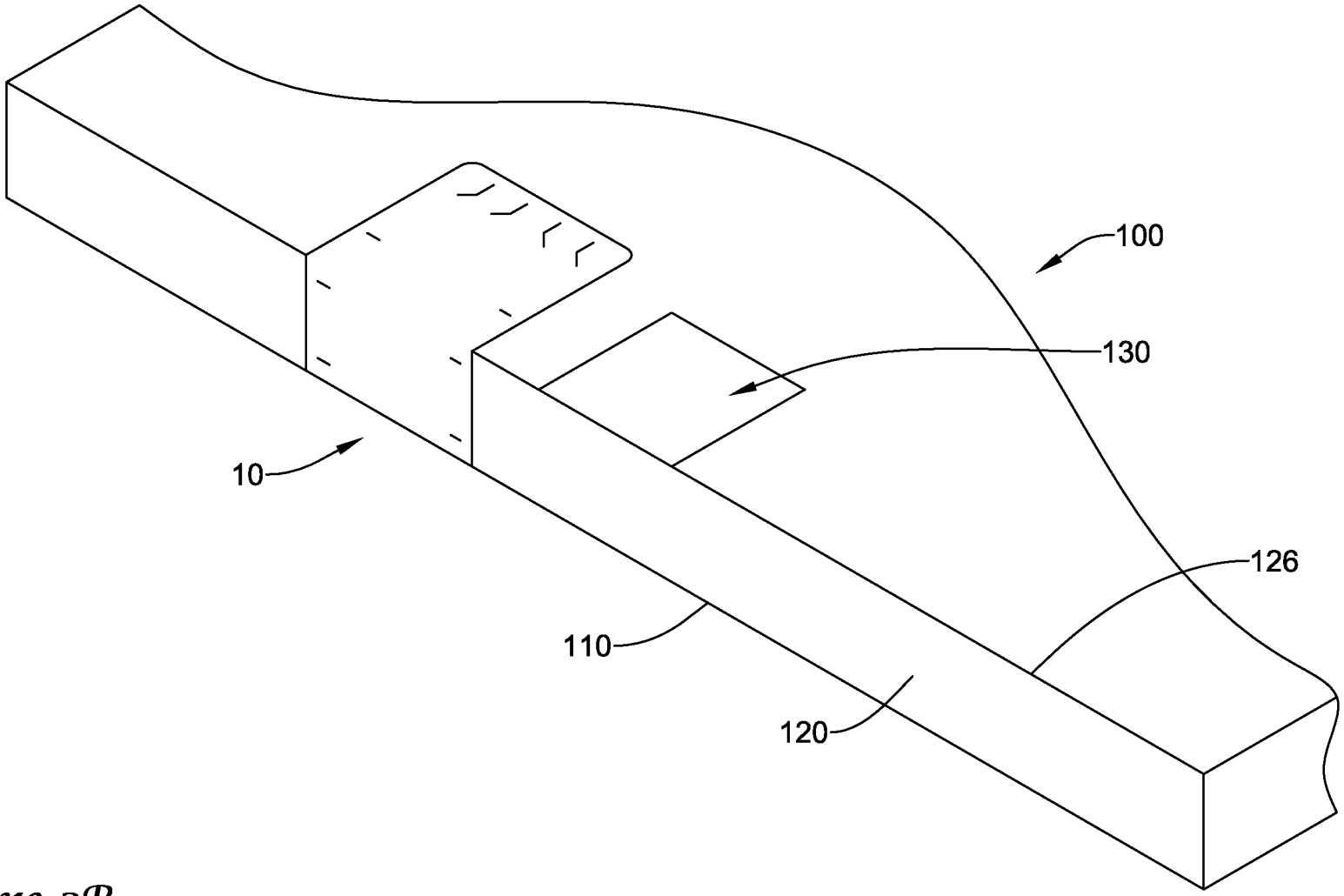
Figure 2B Prior Art
Figure 2C:
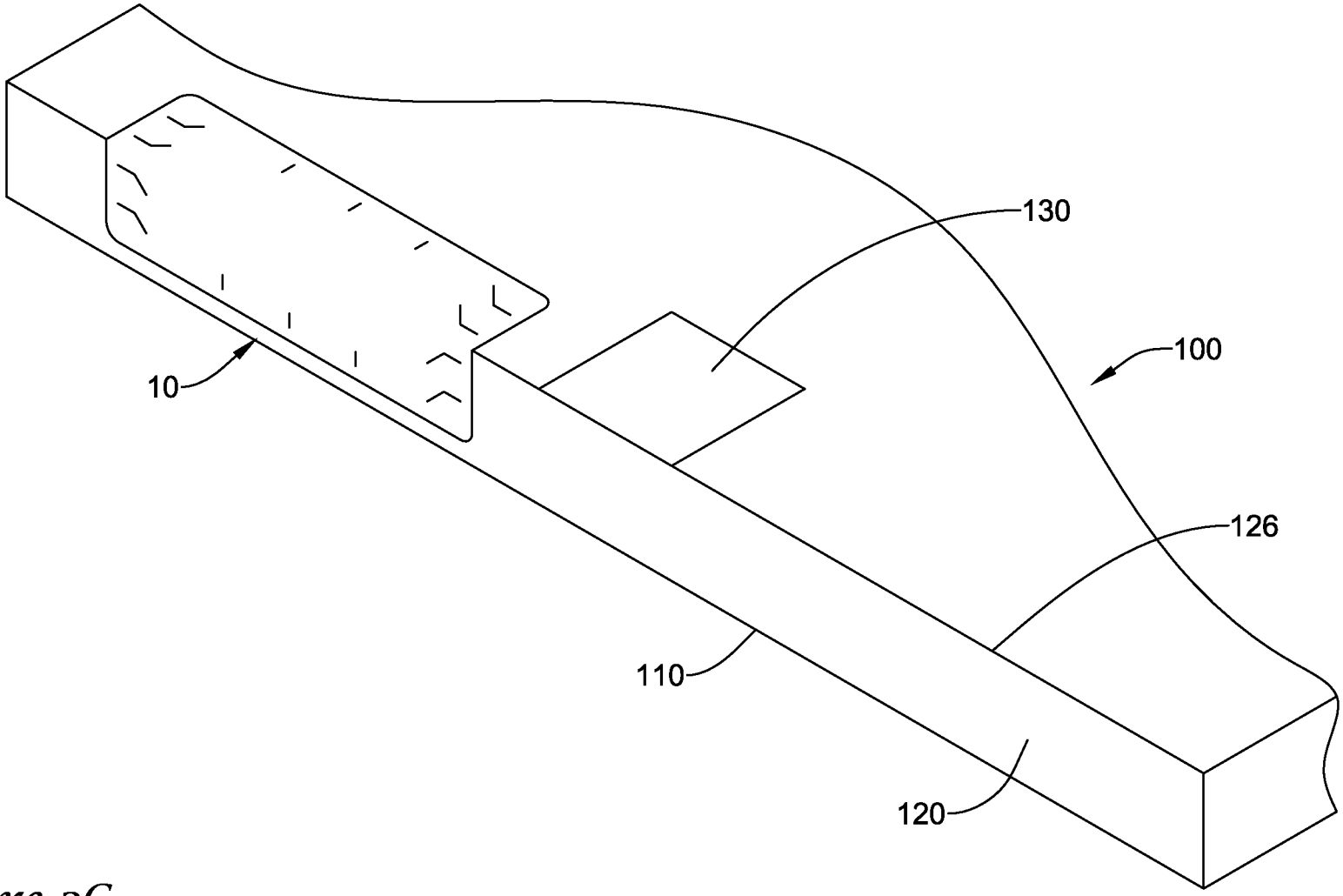
Figure 2C Prior Art
Figure 2D:
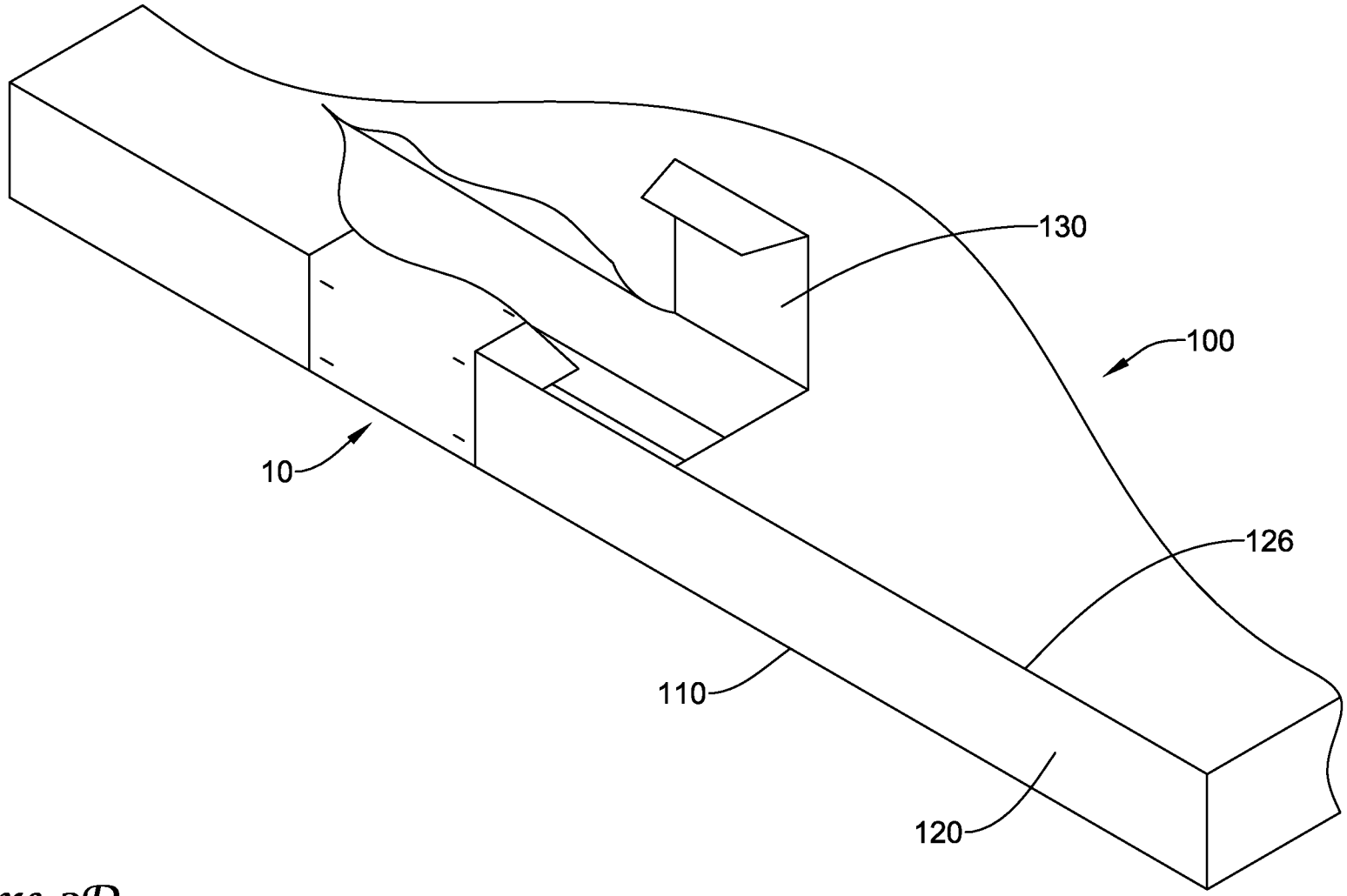
Figure 2D Prior Art
Figure 2E:
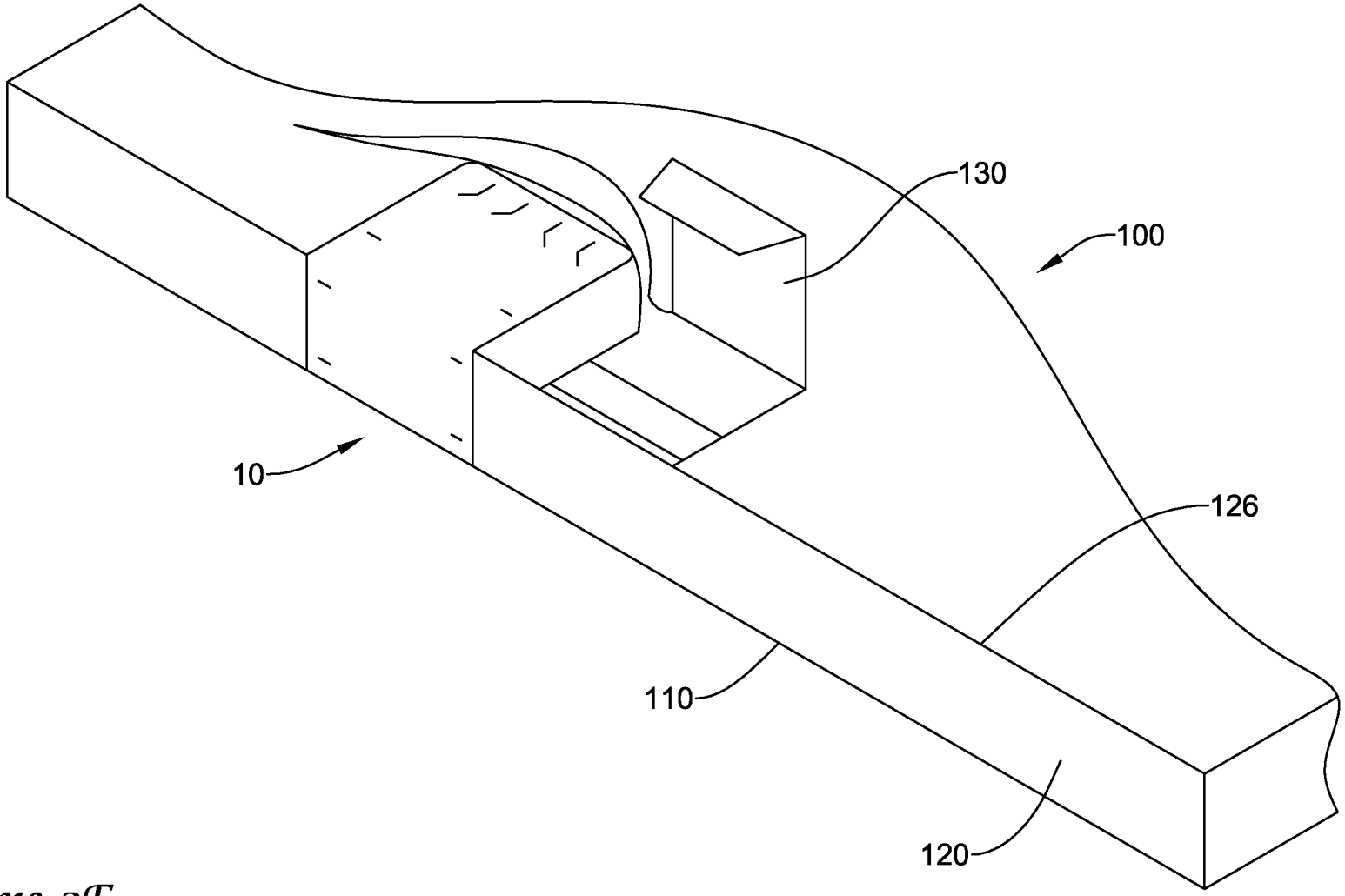
Figure 2E Prior Art

When applied to a package, such as package 100, the closure strip 10 overlaps the flap 120 from a front of the package 100. In some embodiments, the closure strip 10 extends to a back of the package 100 or generally perpendicular to the first flap bend 110, as seen in FIG. 2B. In some embodiments, the closure strip 10 extends along or generally parallel to the second flap bend 126, and does not extend onto the back of the package 100, as seen in FIG. 2C. In order to open the flap 120, the closure strip 10 must first be manually cut or torn. In embodiments having a locking tab 130, the closure strip 10 may be offset from the locking tab 130 such that the closure strip 130 does not overlap the locking tab 130. In some cases, a user attempting to open a package 100 having a closure strip 10 must insert their finger between the flap 120 and the package 100 in order to tear open the closure strip 10. Alternatively, a user must insert a secondary tool such as a cutting blade between the flap 120 and the package 100 in order to cut the closure strip 10—a process which is inconvenient and time consuming. In some cases, a user may tear a portion of the package 100 while or instead of tearing the closure strip 10. Difficult to open packaging may create a negative user experience. For example, FIG. 2D illustrates a package 100 damaged when the closure strip 10 was torn open, for example with a user's finger, and FIG. 2E illustrates a package 100 damaged, while the closure strip 10 remains intact, when the closure strip 10 was attempted to be torn open by a user.

Figure 3A:
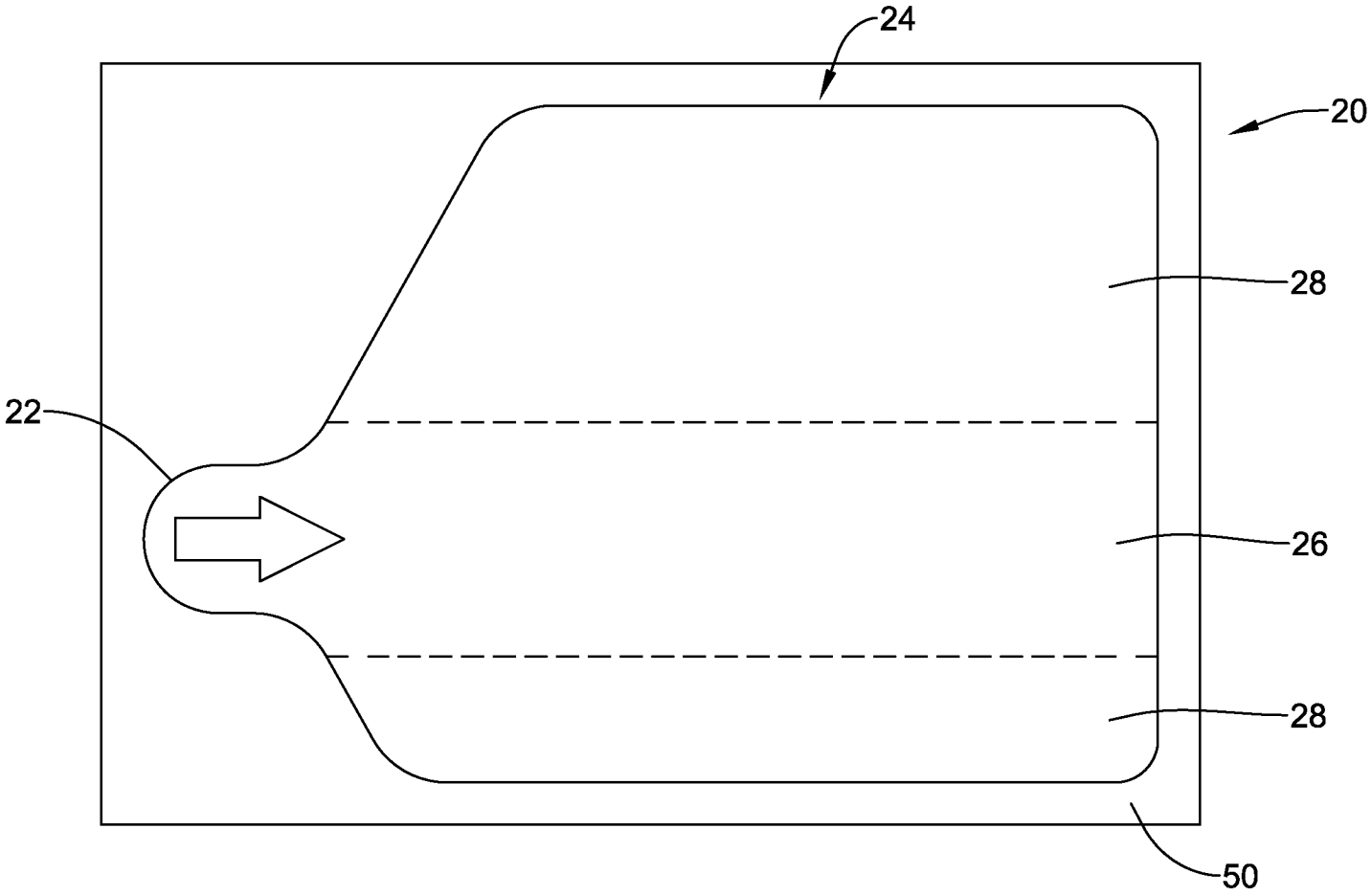
Figure 3A Prior Art
FIGS. 3A-3C illustrate an example prior art closure strip.

FIG. 3A illustrates an example prior art closure strip 20. The closure strip 20 includes a pull tab 22 extending from a body 24 of the closure strip 20. The back face includes a band 26 aligned with the pull tab 22, the band 26 having no adhesive and being flanked by an adhesive portion 28 on either side of the band 26. The closure strip 20 may be removably provided on a backing 50, wherein the adhesive on the back face is configured to peel off the backing 50 when manipulated by a user such that the closure strip 20 peels off whole for application to a package, such as package 100.

Figure 3B:
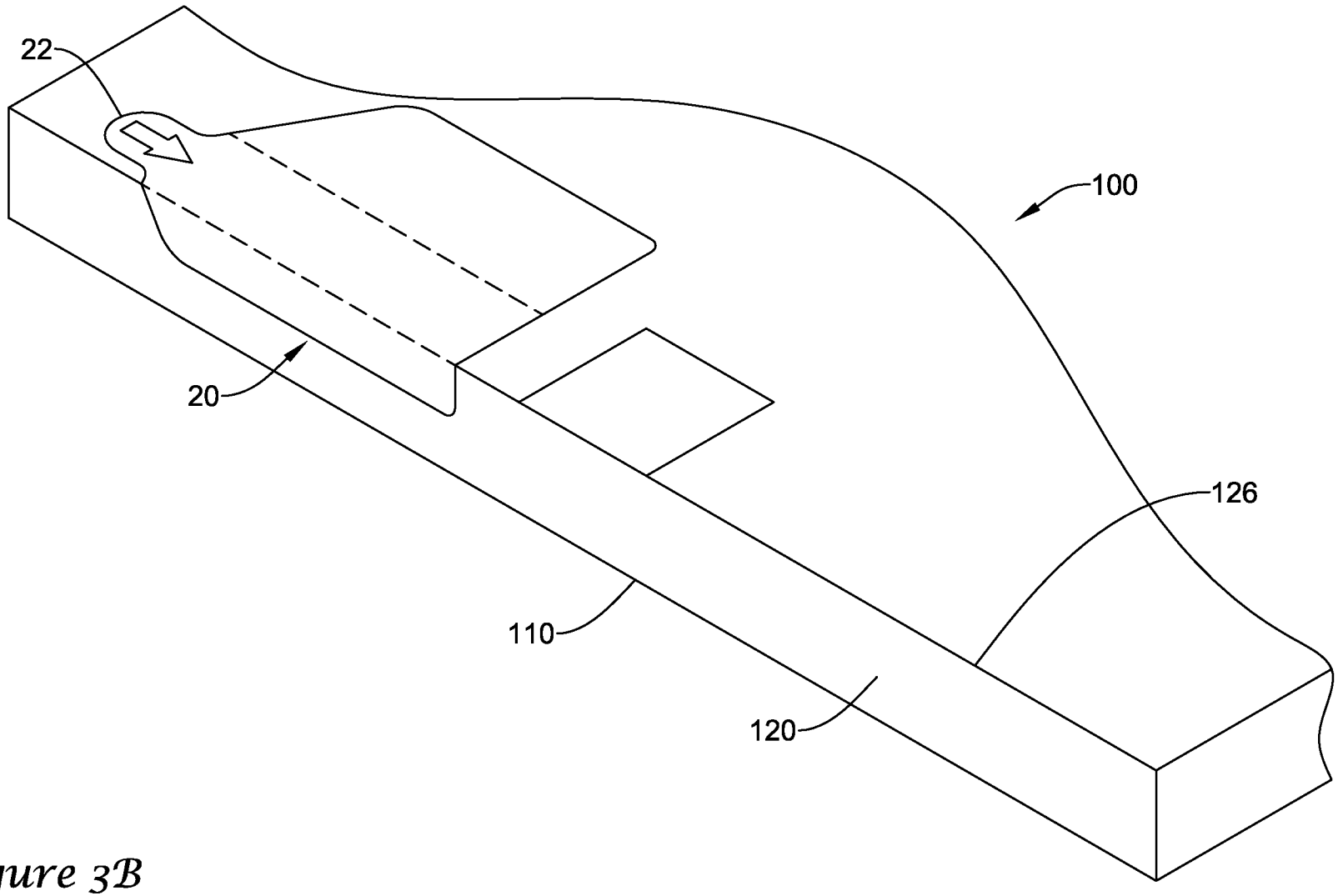
Figure 3B Prior Art
Figure 3C:
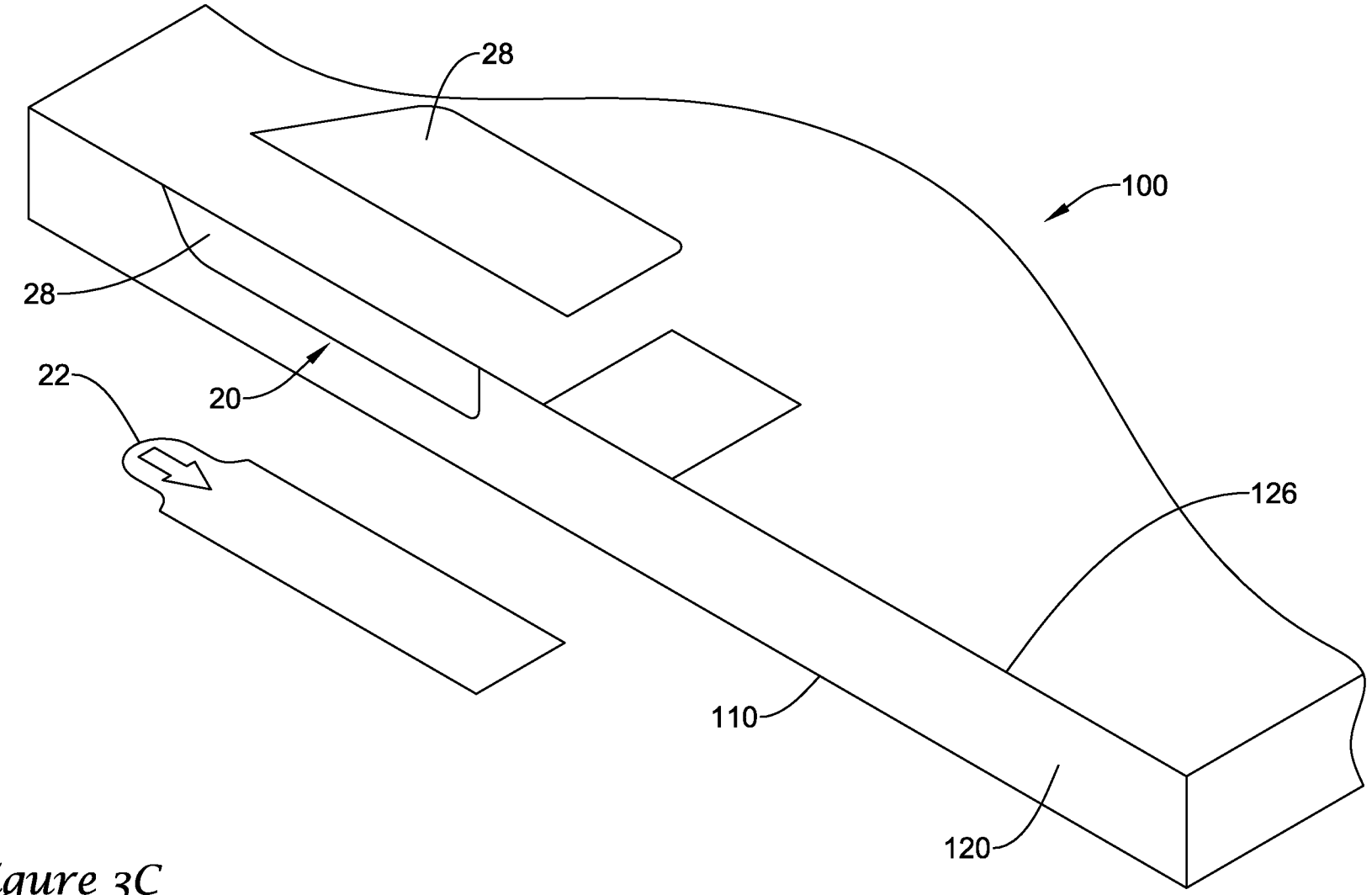
Figure 3C Prior Art

When applied to a package, such as package 100, the closure strip 20 overlaps the flap 120, as seen in FIG. 3B, such that in order to open the flap 120, the closure strip 20 must first be opened by pulling and removing the pull tab 22 in a direction parallel to the first flap bend 110. However, doing so leaves the user holding the pull tab 22, which must then be disposed of During the use of some packaging, packaging for medical devices for example, the removed (i.e., loose) pull tab 22, as may be seen in FIG. 3C, may be inconvenient and time consuming to dispose of, at a moment (i.e., during surgery, for example) where time and/or delay may be a critical factor to a patient's comfort and/or survival.

Applicants have made numerous changes and/or improvements over the prior art closure strips which provide a significantly improved user experience, both during application of the closure strips and during opening of the package, reduced manufacturing cost, and improved performance. Closure strips may have many purposes in addition to simply securing the flap. In some cases, a closure strip may provide visual indicia for inventory, re-stocking, and/or quality control purposes. In some cases, a closure strip may provide evidence of product testing or sterilization. In some cases, a closure strip may provide evidence that a package has remained unopened and/or that a foreign substance has not been introduced to the product. In some cases, a closure strip may provide other benefits and/or uses, as known and understood by one of skill in the art.

Figure 4:
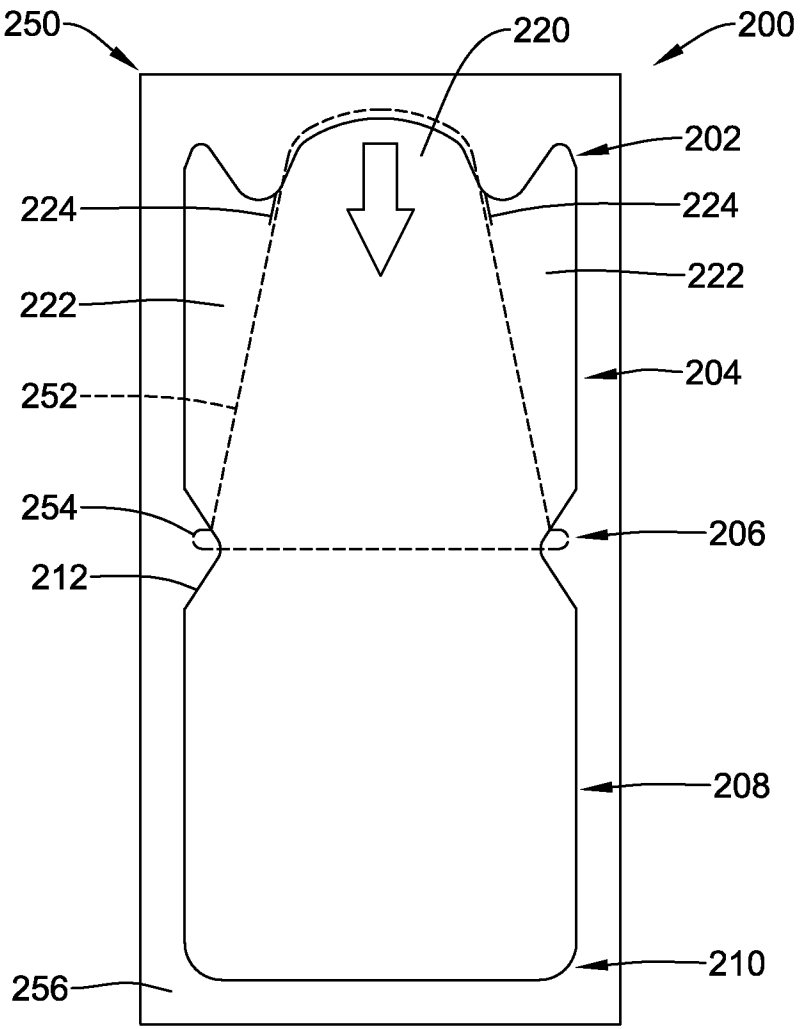
FIG. 4 illustrates an example closure device in accordance with the present disclosure.

FIG. 4 illustrates an example closure device including a closure strip 200 removably disposed on a backing 250, in accordance with the present disclosure. In some embodiments, the closure strip 200 and/or the backing 250 may each be formed from or include a polymer sheet or strip. In some embodiments, the polymer sheet or strip may include, for example, polyethylene terephthalate (PET), polyurethane, polyether-ester, polyester, linear low density polyethylene, polyamide, elastomeric polyamide, block polyamide/ether, a polyether block amide such as PEBA available under the trade name PEBAX®, silicones, polyethylene, Marlex high-density polyethylene, polypropylene, bi-axially oriented polypropylene (BOPP), polyetheretherketone (PEEK), polyimide (PI), polyetherimide (PEI), or composites and/or combinations thereof. In some embodiments, the backing 250 may alternatively or also include paper, glassine, coated paper, interwoven fibers, or other suitable substrate(s). In some embodiments, a front surface of the backing 250 may permit an adhesive (such as on a back face of a closure strip 200, for example) to adhere to and to be peeled off the front surface of the backing 250, but may prevent re-sticking or re-adherence of the adhesive to the front surface of the backing 250 once initially removed. In some embodiments, re-sticking or re-adherence of the adhesive to the front surface of the backing 250 may be permitted. In some embodiments, the adhesive may be an emulsion acrylic, or other suitable permanent adhesive. In some embodiments, the closure strip 200 may be formed of BOPP, such as Fasson® 74864, secured to a PET backing 250 with an emulsion acrylic adhesive, such as Fasson® 5900.

In some embodiments, the closure strip 200 may include a generally linear shape, wherein a length of the closure strip 200 is greater than a width of the closure strip 200. In some embodiments, the length of the closure strip 200 may be about 1.0 inches to about 5.0 inches, about 2.0 inches to about 4.0 inches, about 2.5 inches to about 3.5 inches, or about 2.75 inches to about 3.0 inches. In some embodiments, the width of the closure strip 200 may be about 0.5 inches to about 2.5 inches, about 1.0 inches to about 2.0 inches, or about 1.25 inches to about 1.5 inches. In some embodiments, the length of the closure strip 200 may be less than or about the same as the width of the closure strip 200. In some embodiments, the closure strip 200 may include a first end 202, a first portion 204, a central portion 206, a second portion 208, a second end 210, and a central axis extending from the first end 202 to the second end 210. In some embodiments, the closure strip 200 may include a front face and a back face. In some embodiments, the front face may include ornamental, informational, or functional printing thereon. In some embodiments, the back face may include an adhesive disposed thereon.

Figure 5:
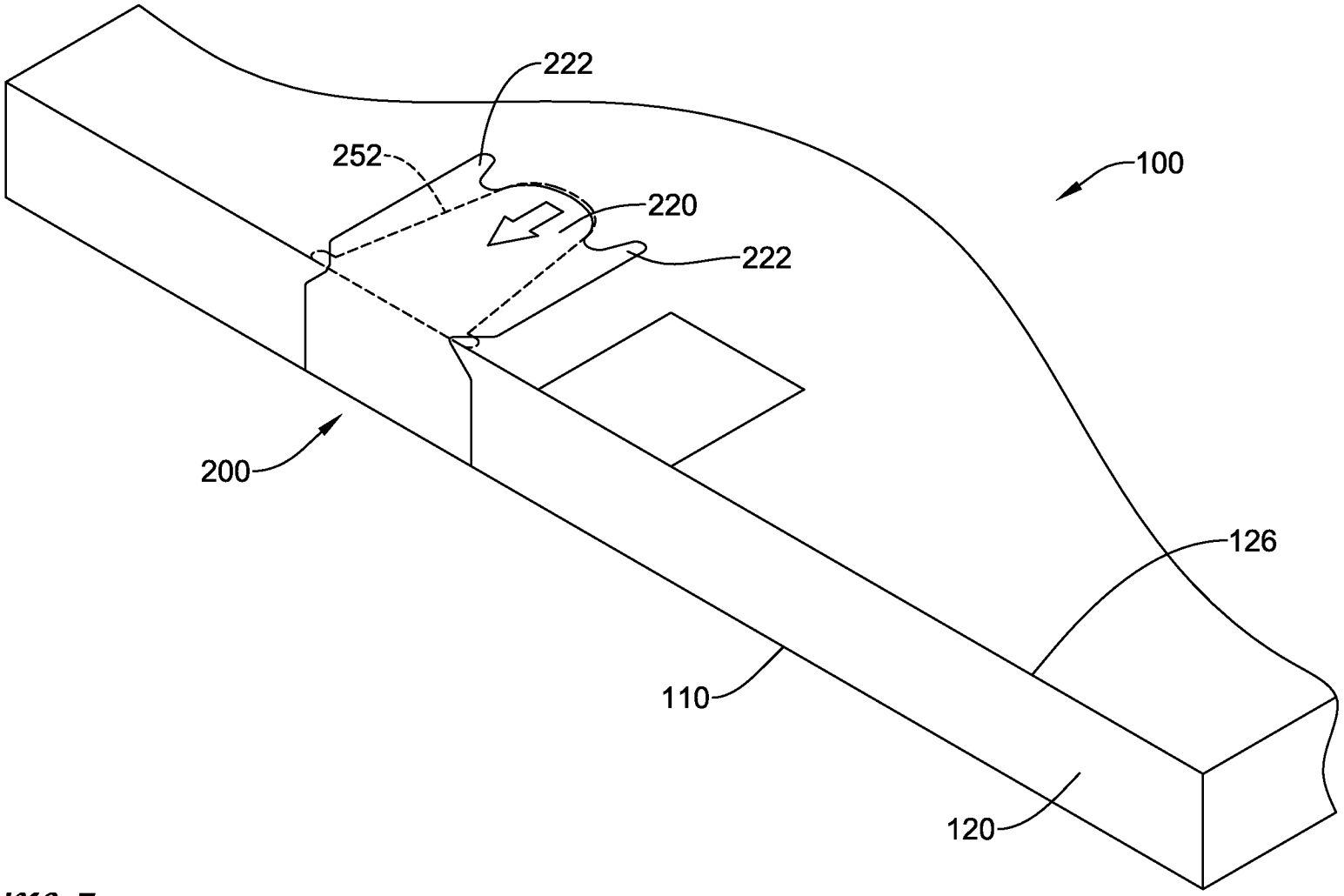
FIGS. 5-7 illustrate a partial perspective view of the closure device of FIG. 4 disposed on the example package of FIG. 1.

In some embodiments, the central portion 206 may include placement notches 212 formed as a pair on opposite sides of the central axis. In some embodiments, the placement notches 212 may be generally symmetrical about the central axis. In some embodiments, the placement notches 212 may be generally V-shaped, U-shaped, squared, rounded, or have other suitable geometry. In some embodiments, the placement notches 212 may cooperate to form a narrowed waist within the central portion 206. During use, the placement notches 212 may be adapted to facilitate proper and/or desired placement of the closure strip 200 on a package 100. In some embodiments, the placement notches 212 may be aligned with one end of the package 100 and/or the second flap bend 126 when the at least one flap 120 is disposed in the closed position, wherein the central axis of the closure strip 200 extends generally perpendicular to the one end of the package 100 and/or the second flap bend 126, as seen in FIG. 5, for example. Placement notches 212 may provide improved location repeatability during application of the closure strip 200 to the package 100.

In some embodiments, the backing 250 may include a breakout portion 252 and a remaining portion 256. The breakout portion 252 may be formed by cutting and/or perforating the backing 250 to include a desired shape, such as by die cutting, laser cutting, or other suitable techniques, wherein the breakout portion 252 remains attached to the remaining portion 256 and/or a part of the backing 250 until the breakout portion 252 is removed by the closure strip 200 when the closure strip 200 is peeled off the backing 250. When the closure strip 200 is peeled off the backing 250, adherence of the adhesive to the breakout portion 252 overcomes the strength of the perforations holding the breakout portion 252 to the remaining portion 256 of the backing 250. As such, the breakout portion 252 remains adhered to the closure strip 200 and separates from the remaining portion 256 as the closure strip 200 is peeled off the backing 250. After removal from the backing 250, the breakout portion 252 provides the first portion 204 of the closure strip 200 with a non-adhesive portion on its back face, for reasons that will become apparent.

In some embodiments, the first portion 204 may include a pair of starter perforations 224 formed therein extending from the first end 202 toward the central portion 206. The pair of starter perforations 224 may be disposed along opposing sides of the breakout portion 252 relative to the central axis. In some embodiments, the pair of starter perforations 224 may be about 0.05 inches to about 0.20 inches long, about 0.075 inches to about 0.15 inches long, or about 0.10 inches long. In some embodiments, the pair of starter perforations 224 may extend through a thickness of the closure strip 200 adjacent a first end of a tear tab 220. The tear tab 220 may generally be defined by the breakout portion 252, and may extend from the first end 202 to the central portion 206 along opposing sides of the breakout portion 252. In some embodiments, the breakout portion 252 may extend from the central portion 206 and/or the placement notches 212 to a position beyond the first end 202 of the closure strip 200. In some embodiments, the first portion 204 may include a pair of recesses at the first end 202. The pair of recesses may be disposed immediately adjacent to opposing sides of the breakout portion 252 and laterally inward (i.e., toward the central axis) from an outer edge of the closure strip 200, wherein the outer edge of the closure strip 200 may be generally aligned with or parallel to the central axis. In some embodiments, the pair of recesses may cooperate with the breakout portion 252 and the first end 202 of the tear tab 220 to provide a location where the closure strip 200 is not adhered to the package 100 for a user to lift and pinch or grasp the tear tab 220. In some embodiments, the breakout portion 252 may extend from the central portion 206 to a position about 0.10 inches, about 0.075 inches, about 0.05 inches, about 0.04 inches, about 0.03 inches, about 0.02 inches, or about 0.01 inches beyond the first end 202, or the breakout portion 252 may not extend past the first end 202.

In some embodiments, the first portion 204 may include a pair of wings 222 extending from the first end 202 to the central portion 206 and/or the placement notches 212 on either side of the tear tab 220. The pair of wings 222 include adhesive on their back face. Each wing 222 may be wider at the first end 202 than at the central portion 206. In some embodiments, the breakout portion 252 may include a rounded extension 254 disposed at the central portion 206 and/or the placement notches 212. On each side of the closure strip 200, one rounded extension 254 may extend into one placement notch 212. In some embodiments, during placement of the closure strip 200 on the package 100, the rounded extensions 254 may be placed along an edge of the opening into the interior of the package 100 and/or along the second flap bend 126, wherein the rounded extensions 254 may at least partially relieve stress concentration(s) at the narrowed waist of the central portion 206.

In some embodiments, the breakout portion 252 may be wider at the central portion 206 than at the first end 202. In some embodiments, opposing sides of the breakout portion 252 relative to the central axis may angle inwardly toward the first end 202 and the central axis. In some embodiments, the opposing sides of the breakout portion may form an angle of about 10 degrees, about 15 degrees, about 20 degrees, about 22 degrees, about 24 degrees, about 25 degrees, about 30 degrees, about 35 degrees, about 40 degrees, about 45 degrees, or other suitable angles as desired. In some embodiments, the breakout portion 252 may form a generally trapezoidal or pyramidal shape. Similarly, in some embodiments, the tear tab 220 may be wider at the central portion 206 than at the first end 202. In some embodiments, the breakout portion 252 may form other suitable shapes having curved or complex outer perimeters, as would be understood by the skilled artisan. The closure strip 200 and/or the tear tab 220 may be actuatable from an applied position to an open position. The closure strip 200 and/or the tear tab 220 may be provided on the backing 250 in the applied position. During use, the closure strip 200 may be peeled off the backing 250, with the breakout portion 252 still attached, and applied or adhered to the package 100 with the tear tab 220 in the applied position, as seen for example, in FIG. 5. When a user desires to open the package 100, the closure strip 200 and/or the tear tab 220 may be actuated to the open position by grasping the first end 202 (i.e. grasping the location where the closure strip 200 is not adhered to the package 100) and pulling such that the tear tab 220 tears at the pair of starter perforations 224 and continues to tear along the outer edges of the breakout portion 252 to the central portion 206. In some embodiments, pulling the tear tab 220 and/or the breakout portion 252 causes the breakout portion 252 to pull through the first portion 204, thereby forming the tear tab 220 between the pair of wings 222. When the tears reach the placement notches 212, the tears stop, and the tear tab 220 has achieved the open position, as seen for example, in FIG. 6. In some embodiments, the tear tab 220 may have an arrow or other indicia printed on its front face adjacent the first end 202 indicating the proper pull direction for actuating the tear tab 220 from the applied position to the open position.

In the open position, the second portion 208 and the pair of wings 222 remain adhered to the package 100—only the tear tab 220 has been pulled off the outer surface of the package 100. Once actuated into the open position, the tear tab 220 cannot be re-adhered to the package 100, due to the non-adhesive portion on its back face provided by the breakout portion 252. In some embodiments, the tear tab 220 may be re-adhered to the package 100 by peeling off the breakout portion 252, returning the tear tab 220 to the applied position, and re-adhering the tear tab 220 to the package 100. When re-adhering the tear tab 220 to the package 100, the tears (between the tear tab 220 and each of the pair of wings 222) would remain visible, thus signifying that the package had been opened and was not suitable for re-stocking. With the tear tab 220 in the open position, a user may continue to pull on the tear tab 220. Due to the second portion 208 remaining adhered to the package 100, and more particularly to the flap 120, pulling on the tear tab 220 may pull the flap 120 open and remove the second panel 126 from the interior of the package 100, as seen for example in FIG. 7, thus easing entry into the package 100 for the user. The closure strip 200 and/or the tear tab 220 permits opening of the package 100 without damaging the package 100. Additionally, since the closure strip 200 remains attached to the package 100, there is no waste that the user is required to dispose of, as in the case of the closure strip 20 described above.

Figure 8:
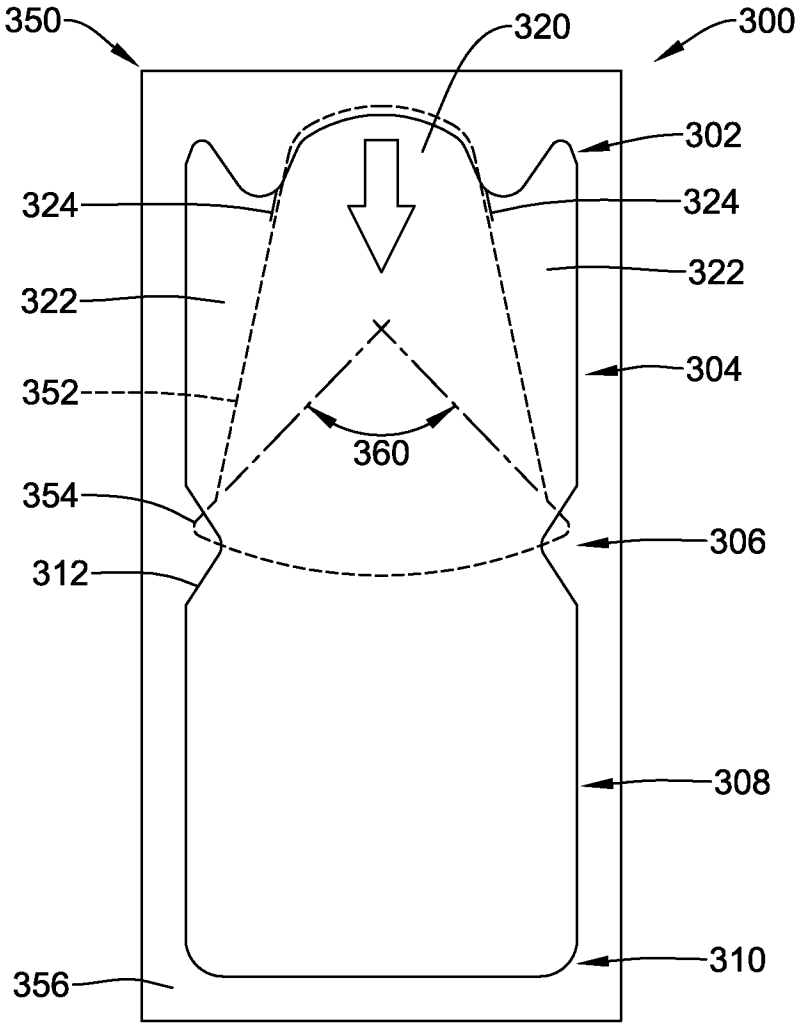
FIG. 8 illustrates an example closure device in accordance with the present disclosure.

FIG. 8 illustrates an example closure device including a closure strip 300 removably disposed on a backing 350, in accordance with the present disclosure. In some embodiments, the closure strip 300 and/or the backing 350 may each be formed from or include a polymer sheet or strip. In some embodiments, the polymer sheet or strip may include, for example, polyethylene terephthalate (PET), polyurethane, polyether-ester, polyester, linear low density polyethylene, polyamide, elastomeric polyamide, block polyamide/ether, a polyether block amide such as PEBA available under the trade name PEBAX®, silicones, polyethylene, Marlex high-density polyethylene, polypropylene, bi-axially oriented polypropylene (BOPP), polyetheretherketone (PEEK), polyimide (PI), polyetherimide (PEI), or composites and/or combinations thereof. In some embodiments, the backing 350 may alternatively or also include paper, glassine, coated paper, interwoven fibers, or other suitable substrate(s). In some embodiments, a front surface of the backing 350 may permit an adhesive (such as on a back face of a closure strip 300, for example) to adhere to and to be peeled off the front surface of the backing 350, but may prevent re-sticking or re-adherence of the adhesive to the front surface of the backing 350 once initially removed. In some embodiments, re-sticking or re-adherence of the adhesive to the front surface of the backing 350 may be permitted. In some embodiments, the adhesive may be an emulsion acrylic, or other suitable permanent adhesive. In some embodiments, the closure strip 300 may be formed of BOPP, such as Fasson® 74864, secured to a PET backing 350 with an emulsion acrylic adhesive, such as Fasson® 5900.

In some embodiments, the closure strip 300 may include a generally linear shape, wherein a length of the closure strip 300 is greater than a width of the closure strip 300. In some embodiments, the length of the closure strip 300 may be about 1.0 inches to about 5.0 inches, about 2.0 inches to about 4.0 inches, about 2.5 inches to about 3.5 inches, or about 2.75 inches to about 3.0 inches. In some embodiments, the width of the closure strip 300 may be about 0.5 inches to about 2.5 inches, about 1.0 inches to about 2.0 inches, or about 1.25 inches to about 1.5 inches. In some embodiments, the length of the closure strip 300 may be less than or about the same as the width of the closure strip 300. In some embodiments, the closure strip 300 may include a first end 302, a first portion 304, a central portion 306, a second portion 308, a second end 310, and a central axis extending from the first end 302 to the second end 310. In some embodiments, the closure strip 300 may include a front face and a back face. In some embodiments, the front face may include ornamental, informational, or functional printing thereon. In some embodiments, the back face may include an adhesive disposed thereon.

In some embodiments, the central portion 306 may include placement notches 312 formed as a pair on opposite sides of the central axis. In some embodiments, the placement notches 312 may be generally symmetrical about the central axis. In some embodiments, the placement notches 312 may be generally V-shaped, U-shaped, squared, rounded, or have other suitable geometry. In some embodiments, the placement notches 312 may cooperate to form a narrowed waist within the central portion 306. During use, the placement notches 312 may be adapted to facilitate proper and/or desired placement of the closure strip 300 on a package 100. In some embodiments, the placement notches 312 may be aligned with one end of the package 100 and/or the second flap bend 126 when the at least one flap 120 is disposed in the closed position, wherein the central axis of the closure strip 300 extends generally perpendicular to the one end of the package 100 and/or the second flap bend 126, as seen in FIG. 5, for example. Placement notches 312 may provide improved location repeatability during application of the closure strip 300 to the package 100.

In some embodiments, the backing 350 may include a breakout portion 352 and a remaining portion 356. The breakout portion 352 may be formed by cutting and/or perforating the backing 350 to include a desired shape, such as by die cutting, laser cutting, or other suitable techniques, wherein the breakout portion 352 remains attached to the remaining portion 356 and/or a part of the backing 350 until the breakout portion 352 is removed by the closure strip 300 when the closure strip 300 is peeled off the backing 350. When the closure strip 300 is peeled off the backing 350, adherence of the adhesive to the breakout portion 352 overcomes the strength of the perforations holding the breakout portion 352 to the remaining portion 356 of the backing 350. As such, the breakout portion 352 remains adhered to the closure strip 300 and separates from the remaining portion 356 as the closure strip 300 is peeled off the backing 350. After removal from the backing 350, the breakout portion 352 provides the first portion 304 of the closure strip 300 with a non-adhesive portion on its back face, for reasons that will become apparent.

In some embodiments, the first portion 304 may include a pair of starter perforations 324 formed therein extending from the first end 302 toward the central portion 306. The pair of starter perforations 324 may be disposed along opposing sides of the breakout portion 352 relative to the central axis. In some embodiments, the pair of starter perforations 324 may be about 0.05 inches to about 0.20 inches long, about 0.075 inches to about 0.15 inches long, or about 0.10 inches long. In some embodiments, the pair of starter perforations 324 may extend through a thickness of the closure strip 300 adjacent a first end of a tear tab 320. The tear tab 320 may generally be defined by the breakout portion 352, and may extend from the first end 302 to the central portion 306 along opposing sides of the breakout portion 352. In some embodiments, the breakout portion 352 may extend from the central portion 306 and/or the placement notches 312 to a position beyond the first end 302 of the closure strip 300. In some embodiments, the first portion 304 may include a pair of recesses at the first end 302. The pair of recesses may be disposed immediately adjacent to opposing sides of the breakout portion 352 and laterally inward (i.e., toward the central axis) from an outer edge of the closure strip 300, wherein the outer edge of the closure strip 300 may be generally aligned with or parallel to the central axis. In some embodiments, the pair of recesses may cooperate with the breakout portion 352 and the first end 302 of the tear tab 320 to provide a location where the closure strip 300 is not adhered to the package 100 for a user to lift and pinch or grasp the tear tab 320. In some embodiments, the breakout portion 352 may extend from the central portion 306 to a position about 0.10 inches, about 0.075 inches, about 0.05 inches, about 0.04 inches, about 0.03 inches, about 0.02 inches, or about 0.01 inches beyond the first end 302, or the breakout portion 352 may not extend past the first end 302.

In some embodiments, the first portion 304 may include a pair of wings 322 extending from the first end 302 to the central portion 306 and/or the placement notches 312 on either side of the tear tab 320. The pair of wings 322 include adhesive on their back face. Each wing 322 may be wider at the first end 302 than at the central portion 306. In some embodiments, the breakout portion 352 may include a rounded extension 354 disposed at the central portion 306 and/or the placement notches 312. On each side of the closure strip 300, one rounded extension 354 may extend into one placement notch 312. In some embodiments, during placement of the closure strip 300 on the package 100, the rounded extensions 354 may be placed along an edge of the opening into the interior of the package 100 and/or along the second flap bend 126, wherein the rounded extensions 354 may at least partially relieve stress concentration(s) at the narrowed waist of the central portion 306. In some embodiments, the rounded extensions 354 may each include an outer edge portion angled inwardly toward the first end 302 and the central axis, thereby cooperating to form an angle 360, as seen for example, in FIG. 8. In some embodiments, the angle 360 may be about 60 degrees, about 70 degrees, about 80 degrees, about 90 degrees, about 100 degrees, about 110 degrees, about 120 degrees, or other suitable angles as desired.

In some embodiments, the breakout portion 352 may be wider at the central portion 306 than at the first end 302. In some embodiments, opposing sides of the breakout portion 352 relative to the central axis may angle inwardly toward the first end 302 and the central axis from the outer edge portions forming the angle 360. In some embodiments, the opposing sides of the breakout portion may form an angle of about 10 degrees, about 15 degrees, about 20 degrees, about 22 degrees, about 24 degrees, about 25 degrees, about 30 degrees, about 35 degrees, about 40 degrees, about 45 degrees, or other suitable angles as desired. In some embodiments, the breakout portion 352 may form a generally trapezoidal or pyramidal shape. In some embodiments, the breakout portion 352 may include a curved or rounded edge extending toward the second end 310 at the central portion 306, as seen for example, in FIG. 8. Similarly, in some embodiments, the tear tab 320 may be wider at the central portion 306 than at the first end 302. In some embodiments, the breakout portion 352 may form other suitable shapes having curved or complex outer perimeters, as would be understood by the skilled artisan. The closure strip 300 and/or the tear tab 320 may be actuatable from an applied position to an open position. The closure strip 300 and/or the tear tab 320 may be provided on the backing 350 in the applied position.

Figure 6:
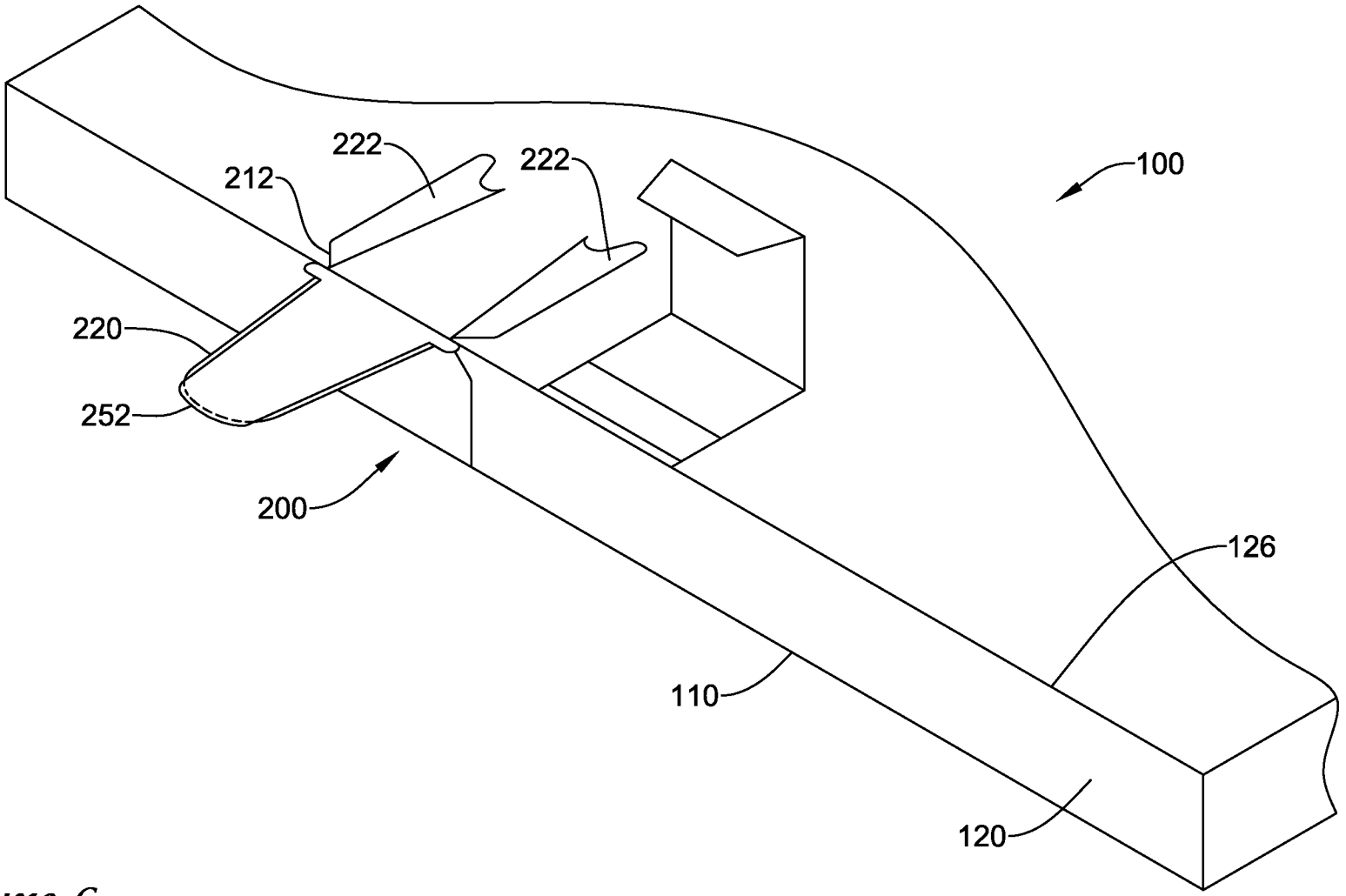
Figure 7:
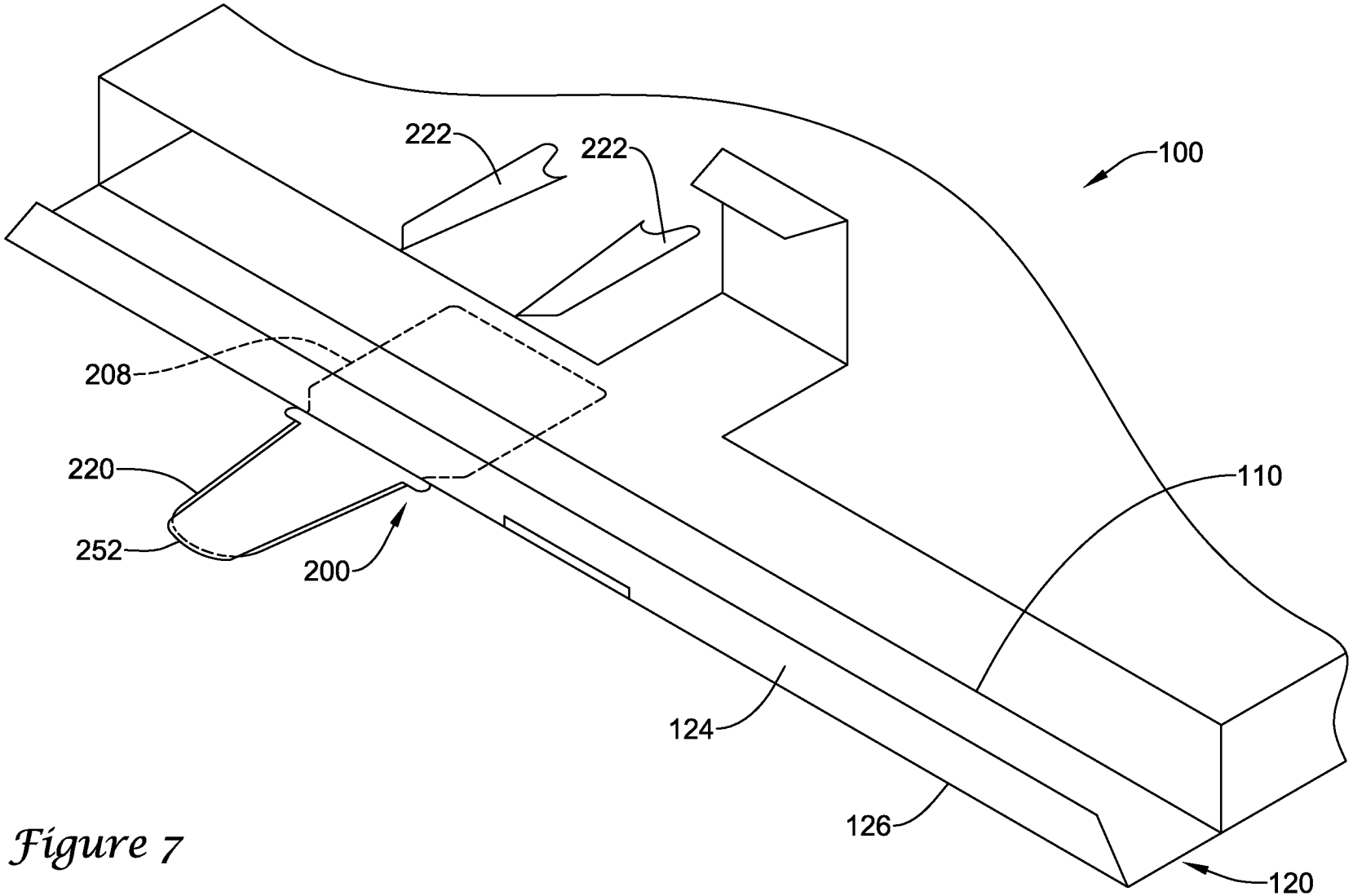

Closure strip 300 may be used with a package 100, for example, in the manner described above with respect to closure strip 200 and illustrated in FIGS. 5-7. During use, the closure strip 300 may be peeled off the backing 350, with the breakout portion 352 still attached, and applied or adhered to the package 100 with the tear tab 320 in the applied position, as seen for example, in FIG. 5. When a user desires to open the package 100, the closure strip 300 and/or the tear tab 320 may be actuated to the open position by grasping the first end 302 (i.e. grasping the location where the closure strip 300 is not adhered to the package 100) and pulling such that the tear tab 320 tears at the pair of starter perforations 324 and continues to tear along the outer edges of the breakout portion 352 to the central portion 306. In some embodiments, pulling the tear tab 320 and/or the breakout portion 352 causes the breakout portion 352 to pull through the first portion 304, thereby forming the tear tab 320 between the pair of wings 322. When the tears reach the placement notches 312, the tears stop, and the tear tab 320 has achieved the open position, as seen for example, in FIG. 6. In some embodiments, the tear tab 320 may have an arrow or other indicia printed on its front face adjacent the first end 302 indicating the proper pull direction for actuating the tear tab 320 from the applied position to the open position.

In the open position, the second portion 308 and the pair of wings 322 remain adhered to the package 100—only the tear tab 320 has been pulled off the outer surface of the package 100. Once actuated into the open position, the tear tab 320 cannot be re-adhered to the package 100, due to the non-adhesive portion on its back face provided by the breakout portion 352. In some embodiments, the tear tab 320 may be re-adhered to the package 100 by peeling off the breakout portion 352, returning the tear tab 320 to the applied position, and re-adhering the tear tab 320 to the package 100. When re-adhering the tear tab 320 to the package 100, the tears (between the tear tab 320 and each of the pair of wings 322) would remain visible, thus signifying that the package had been opened and was not suitable for re-stocking. With the tear tab 320 in the open position, a user may continue to pull on the tear tab 320. Due to the second portion 308 remaining adhered to the package 100, and more particularly to the flap 120, pulling on the tear tab 320 may pull the flap 120 open and remove the second panel 126 from the interior of the package 100, as seen for example in FIG. 7, thus easing entry into the package 100 for the user. The closure strip 300 and/or the tear tab 320 permits opening of the package 100 without damaging the package 100. Additionally, since the closure strip 300 remains attached to the package 100, there is no waste that the user is required to dispose of, as in the case of the closure strip 20 described above.

Although the illustrative examples described above relate to closure strips for use on a flap of a carton or box, placement in other locations and/or for other uses is also contemplated. In such an embodiment, the dimensions of the closure strip may be adjusted to better suit the particular placement location and/or use.

Various modifications and alterations of this invention will become apparent to those skilled in the art without departing from the scope and principles of this invention, and it should be understood that this invention is not to be unduly limited to the illustrative embodiments set forth hereinabove. All publications and patents are herein incorporated by reference to the same extent as if each individual publication or patent was specifically and individually indicated to be incorporated by reference.

We claim:

1. A closure device for product packaging, comprising:
a backing; and
a closure strip removably disposed on the backing;
wherein the closure strip includes a first end, a second end opposite the first end, a first portion adjacent the first end, a second portion opposite the first portion and adjacent the second end, and a central portion disposed between the first portion and the second portion;
wherein the closure strip includes a permanent adhesive on a back face thereof adapted to affix the closure strip to a package;
wherein a breakout portion of the backing is configured to separate from a remaining portion of the backing and remain adhered to the closure strip when the closure strip is removed from the backing;
wherein the backing is configured to prevent re-adherence of the adhesive thereto after the closure strip is removed from the backing.

2. The closure device of claim 1, wherein the backing is free of adhesive.

3. The closure device of claim 1, wherein the closure strip includes a pair of starter perforations disposed along opposing outside edges of the breakout portion relative to a longitudinal centerline of the closure strip.

4. The closure device of claim 3, wherein while affixed to the package, the first portion is configured to tear at the pair of starter perforations and along the opposing outside edges of the breakout portion when pulled in a direction generally away from the package to define a tear tab.

5. The closure device of claim 4, wherein the tear tab comprises less than all of the first portion.

6. The closure device of claim 5, wherein the first portion includes a pair of wings laterally disposed along opposing sides the tear tab, the pair of wings configured to remain affixed to the package when the tear tab is pulled away.

7. The closure device of claim 4, wherein the second portion is configured to remain affixed to the package when the tear tab is pulled away.

8. The closure device of claim 7, wherein the tear tab remains attached to the second portion after the tear tab is pulled away from the package.

9. The closure device of claim 4, wherein the tear tab extends from the central portion to the first end.

10. The closure device of claim 1, wherein the closure strip includes a pair of placement notches disposed at the central portion on opposing sides of a longitudinal centerline of the closure strip.

11. The closure device of claim 1, wherein the adhesive includes an emulsion acrylic.

12. The closure device of claim 1, wherein the closure strip is formed from bi-axially oriented polypropylene.

13. The closure device of claim 1, wherein the backing is formed from polyethylene terephthalate.

14. A closure strip, comprising:
a first end;
a second end opposite the first end;
a first portion adjacent the first end;
a second portion opposite the first portion and adjacent the second end; and
a central portion disposed between the first portion and the second portion;
wherein the closure strip includes a permanent adhesive on a back face thereof, the adhesive being adapted to affix the closure strip to a package;
wherein the closure strip further includes a non-adhesive backing element configured to break out of a remaining backing portion when the closure strip is removed from the remaining backing portion, the backing element being adhered to the first portion on the back face such that at least part of the first portion has no exposed adhesive, the backing element defining an outer perimeter of a tear tab within the first portion, the tear tab extending from the first end to the central portion;

wherein the remaining backing portion is configured to prevent re-adherence of the adhesive thereto after the closure strip is removed from the remaining backing portion.

15. The closure strip of claim 14, wherein the first portion includes a pair of spaced-apart wings disposed adjacent to the tear tab, the pair of wings having exposed adhesive configured to affix the first portion to the package.

16. The closure strip of claim 14, wherein the first portion is configured to be affixed to a front face of the package and the second portion is configured to be affixed to a separate portion of the package.

17. The closure strip of claim 16, wherein the tear tab is configured to be subsequently removed from the front face of the package; and wherein all portions of the closure strip remain attached to the package after removing the tear tab from the front face of the package.

* * * * *